US011376604B2

(12) United States Patent
Nied et al.

(10) Patent No.: US 11,376,604 B2
(45) Date of Patent: Jul. 5, 2022

(54) METHOD FOR CRUSHING OF GRINDING MATERIAL AND CORRESPONDING MILL

(71) Applicant: NETZSCH Trockenmahltechnik GmbH, Selb (DE)

(72) Inventors: Roland Nied, Bonstetten (DE); Hermann Sickel, Gambach/Muenzenberg (DE)

(73) Assignee: NETZSCH Trockenmahltechnik GmbH, Hanau (DE)

( * ) Notice: Subject to any disclaimer, the term of this patent is extended or adjusted under 35 U.S.C. 154(b) by 327 days.

(21) Appl. No.: 15/736,683

(22) PCT Filed: Jun. 14, 2016

(86) PCT No.: PCT/DE2016/000247
§ 371 (c)(1),
(2) Date: Dec. 14, 2017

(87) PCT Pub. No.: WO2016/202320
PCT Pub. Date: Dec. 22, 2016

(65) Prior Publication Data

US 2018/0214884 A1 Aug. 2, 2018

(30) Foreign Application Priority Data

Jun. 15, 2015 (DE) ..... 20 2015 004 167.1

(51) Int. Cl.

| | |
|---|---|
| ***B02C 17/18*** | (2006.01) |
| ***B02C 19/06*** | (2006.01) |
| ***B02C 17/16*** | (2006.01) |
| ***B02C 23/30*** | (2006.01) |
| ***B02C 23/24*** | (2006.01) |

(52) U.S. Cl.
CPC ..... *B02C 17/1885* (2013.01); *B02C 17/16* (2013.01); *B02C 17/161* (2013.01); *B02C 17/186* (2013.01); *B02C 19/06* (2013.01); *B02C 19/068* (2013.01); *B02C 23/24* (2013.01); *B02C 23/30* (2013.01)

(58) Field of Classification Search
CPC . B02C 17/186; B02C 17/1885; B02C 19/068; B02C 23/24; B02C 23/30
See application file for complete search history.

(56) References Cited

U.S. PATENT DOCUMENTS

| | | | | |
|---|---|---|---|---|
| 4,932,166 | A * | 6/1990 | Boecker | B02C 17/16 51/293 |
| 2002/0003179 | A1* | 1/2002 | Verhoff | B02C 17/161 241/21 |
| 2006/0108457 | A1* | 5/2006 | Pratt | B22F 1/0044 241/22 |
| 2006/0112856 | A1* | 6/2006 | Brychcy | C09D 7/41 106/412 |
| 2007/0179332 | A1* | 8/2007 | Madar | B29B 17/02 588/321 |
| 2012/0227315 | A1* | 9/2012 | Taylor | C10L 9/08 44/280 |
| 2012/0298782 | A1* | 11/2012 | Nied | B02C 23/18 241/5 |
| 2013/0187085 | A1* | 7/2013 | Eigen | C01B 3/0078 252/184 |

FOREIGN PATENT DOCUMENTS

| | | | | |
|---|---|---|---|---|
| DE | 102006048864 | A1 | 4/2008 | |
| EP | 0969104 | A1 * | 1/2000 | B01J 2/04 |
| EP | 0969104 | A1 | 1/2000 | |
| WO | 0185345 | A1 | 11/2001 | |

OTHER PUBLICATIONS

International Search Report & Written Opinion of the International Searching Authority Application No. PCT/DE2016/000247 Completed Date: Oct. 7, 2016; dated Oct. 18, 2016 8 pages.

* cited by examiner

*Primary Examiner* — Jessica Cahill
*Assistant Examiner* — Jared O Brown
(74) *Attorney, Agent, or Firm* — Whitmyer IP Group LLC

(57) ABSTRACT

A method is disclosed for crushing material to be ground with a mill which contains a grinding chamber which is connected to a feed for material to be ground and to an outlet for ground particles, and contains grinding devices for producing particles of the desired fineness from the fed material to be ground, wherein the grinding takes place in a reducing atmosphere which contains a reduction gas. Also disclosed, is a mill having a grinding chamber which is connected to a feed for material to be ground and to an outlet for ground particles, and contains grinding devices for producing particles of the desired fineness from the fed material to be ground, wherein the grinding chamber contains a reducing atmosphere in which the grinding takes place and which contains a reduction gas.

18 Claims, 1 Drawing Sheet

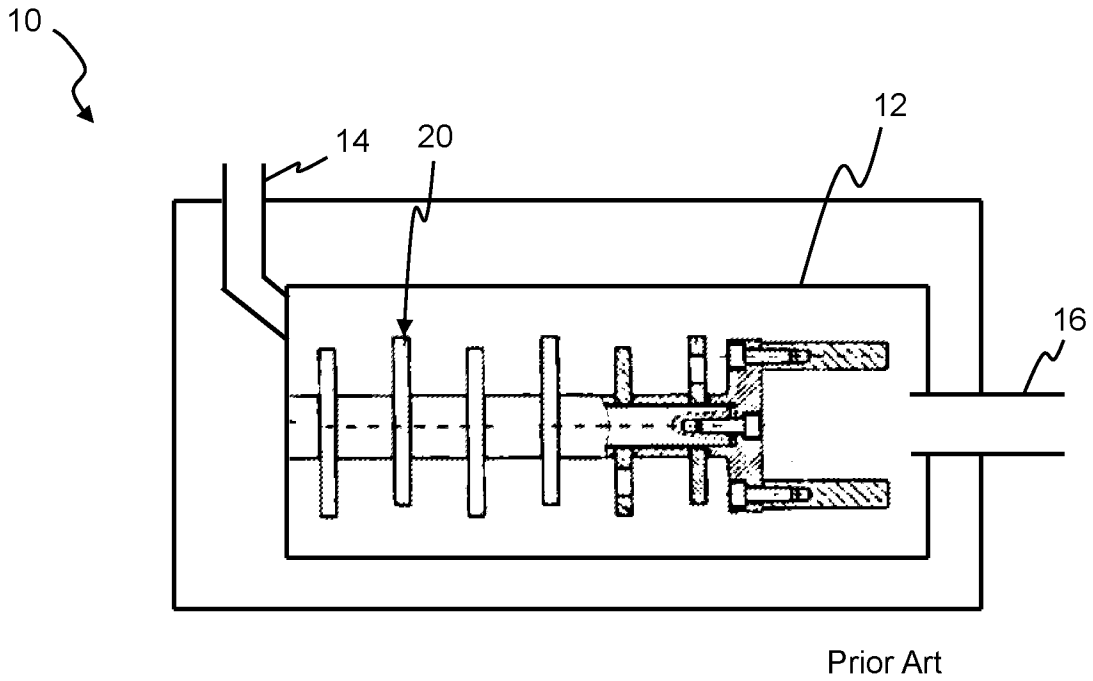
Prior Art

METHOD FOR CRUSHING OF GRINDING MATERIAL AND CORRESPONDING MILL

TECHNICAL FIELD

The present invention relates to a method for the crushing of grinding material by a mill and a mill for executing such a method.

BACKGROUND

Numerous methods are known in the art for crushing of grinding material, along with related mills, such as, for example, a jet mill and in particular continuously operated dry agitator mills. For the prior art concerning the operating methods and structural characteristics of jet mills and agitator mills, reference is made in particular to the related publications on Wikipedia for the terms "jet mill", "mill (grinding)", "database: fluidized bed jet mill.jpg", "solidswiki jet mills", "stirred ball mill", "ball mill", "bead mill" and the like, with the particular publication status prior to the application date of the present application.

Such mills and their operating methods make it possible to produce particles of desired size. If oxygen-free grinding is required for the material of these particles, such as with rare soils that are used, for instance, for magnets in wind power plants, or with high-purity silicon, which is commonly employed to produce magnets, then grinding in today's practice occurs in a protective gas atmosphere. Even such a method, however, fails to ensure oxygen-free grinding of a sufficient scale and quantity, because protective gases cannot be made available in a completely oxygen-free state, and the ground particles continue to include relevant and undesired contamination with oxygen, which diminishes the quality of the material produced.

SUMMARY

It is therefore the object of the present invention to provide a method for the crushing of grinding material by a mill along with a related mill, in order to obtain ground particles without oxygen contamination or at least ground particles with a lower oxygen contamination than by grinding in a protective gas atmosphere.

This object is achieved with a method for the crushing of grinding material by a mill as well as a mill.

The invention accordingly provides a method for the crushing of milling material by a mill 10, which contains a grinding chamber 12 that is connected to a grinding material 14 feed and an outlet 16 for ground particles, and contains grinding devices 20 for producing particles of the desired fineness from the fed grinding material, wherein the invention foresees that grinding occurs in a reducing atmosphere that contains a reduction gas (FIG. 1).

In other words, during the grinding process a reduction reaction gas is introduced into the grinding chamber for a reduction reaction between produced particles and reduction reaction gas, or it is present there and reacts with the escape of grinding material and particles from there, with the latter reducing. The invention thus provides a combination of grinding and simultaneous reduction reaction, or in other words a reducing crushing.

To ensure the desired reduction reaction in the required manner, the method can also provide that the operating parameters of the mill, such as performance and endurance in the grinding chamber, output, etc. are appropriately adjusted or controlled.

Preferred and advantageous configurations of the method are disclosed in the subsidiary claims for the method or combinations of them.

The invention also provides a mill with a grinding chamber, which is connected to a grinding material feed and an outlet for ground particles and contains grinding devices to produce particles of desired fineness from the fed grinding materials, wherein the invention foresees that the grinding chamber contains a reducing atmosphere in which the grinding occurs and which contains a reduction gas.

To ensure the desired reduction reaction in the required manner, it can be foreseen by means of a control of the device that the operating parameters of the mill, such as performance and endurance in the grinding chamber, output, and so on, are appropriately adjusted or controlled.

Preferred and advantageous configurations of the mill are disclosed in the subsidiary claims for the device and combinations of them.

In the context of the present invention and the present documents, the term "reduction gas" can also be considered as meaning reduction reaction gas.

The reduction gas has the effect that, when combined with oxygen, it binds it. Use of hydrogen ($H_2$) as reduction gas leads to the following reaction:

$$2H_2+O_2 \rightarrow 2H_2O$$

and use of carbon monoxide as reduction gas leads to the following reaction:

$$2CO+O_2 \rightarrow 2CO_2$$

Additional preferred and/or advantageous configurations of the invention and of its individual aspects are obtained from combinations of the subsidiary claims and from all documents included with the present application.

By way of example, a few additional concrete configurations and explanations are provided hereinafter.

The invention is described in further detail only by way of example with reference to the described embodiments and sample applications; that is, the invention is not restricted to these embodiments and sample applications. Features of the method and of the device are each disclosed analogously from the descriptions of the device and/or method.

Individual features disclosed and/or depicted in relation with a concrete embodiment are not restricted to the said embodiment or to the combination with the other features of said embodiment, but rather can be combined, in the context of technical possibility, with any other variants, even if they are not treated separately in the present documents.

The subject is a method for the crushing of grinding material by a mill, which contains a grinding chamber that is connected to a grinding material feed and an outlet for ground particles and contains grinding devices to produce particles of the desired fineness from the fed grinding material. In the process, grinding occurs in a reducing atmosphere. For this purpose, a reduction gas is present in the grinding chamber or is fed into the grinding chamber, so that in the preferred case of a jet mill, said gas is simultaneously the grinding gas.

This method is therefore a combination of grinding and simultaneous reduction reaction, or in other words a reducing crushing process. To ensure the desired reduction reaction in the required manner, the method foresees that the operating parameters of the mill, such as performance and endurance in the grinding chamber, output, etc. are appropriately adjusted or controlled.

To execute the aforementioned method and its possible configurations, use is made of a mill with a grinding chamber which is connected to a grinding material feed and an outlet for ground particles and contains grinding devices to produce particles of the desired fineness from the fed grinding material, while the invention foresees that the grinding chamber contains a reducing atmosphere in which the grinding occurs and also contains a reduction gas. To ensure the desired reduction reaction in the required manner, the operating parameters of the mill, such as performance and endurance in the grinding chamber, output, etc., are appropriately adjusted or controlled by a control device.

The mill is preferably configured in such a way that the degree of fineness of grinding is equal to $d_{50}<1$ μm. For this purpose, a control device is provided to appropriately adjust or to control the operating parameters of the mill, such as performance and endurance in the grinding chamber, output, etc.

It is also preferable that the reduction gas is thus hydrogen ($H_2$) or carbon monoxide (CO) or a mixture of the two.

An additional preferred configuration foresees feedback devices from the outlet for ground particles to the grinding materials feed, so that particles ground at least once are, in addition, passed through the mill once or preferably more than once.

It is also advantageous to provide the integration of an air classifier.

Even more preferably, the mill takes the form of a dry agitator mill that, in particular, operates continuously.

Alternatively to the agitator mill, a jet mill can be used, preferably one that includes nozzle-type feeders for grinder gas, in order to inject jets of grinder gas into the interior of the grinding chamber to produce particles of desired fineness from the fed grinder material for jet grinding, and the grinder gas contains the reduction gas or the reduction gas, which is required for the reduction reaction to which the ground particles are to be subjected, is used as grinder gas.

In the context of the present invention and documentation, the term "reduction gas" can also be understood to mean reduction reaction gas.

The reduction gas has the effect that, on encountering oxygen, it bonds with it. Thus, when hydrogen ($H_2$) is employed as reduction gas, the following reaction occurs:

$$2H_2+O_2 \rightarrow 2H_2O$$

and when carbon monoxide is used as reduction gas, the reaction is as follows:

$$2CO+O_2 \rightarrow 2CO_2$$

DETAILED DESCRIPTION

Hereinafter, the basic principles and effects of the invention, as well as the particular advantages in using hydrogen as reduction reaction gas, or reduction gas for short, are introduced by presenting physical connections and relevant magnitudes.

By using hydrogen as reduction reaction gas, or in some cases simultaneously as grinding gas, it is possible not only to extract metals from its oxide but also to perform grinding operations at reducing atmosphere. An additional characteristic can be advantageously employed here: On the basis of its thermodynamic properties, hydrogen placed under pressure at identical temperatures and pressures expands at an approximately 3.7—fold speed in comparison with nitrogen, for example. As an advantageous result, greater speed of the gas jets is achieved with the use of a jet mill without additional means, if the reducing atmosphere is produced by $H_2$.

As a result of the reducing atmosphere in the grinding chamber or, according to this method, as the environment of the grinding, it is possible, for example, to protect purity metals Al, Si and the like from oxidation, in particular. Passivation by oxidation on the surface of particles, particularly in fracture zones, is avoided. Reactivity of the purity metals is unaffected.

The use of specific reduction gases or reduction reaction gases as grinding gas, in the case of the jet mill and jet milling, yields additional favorable impacts on the grinding itself, in addition to the aforementioned advantages of reducing grinding.

The outlet speed of the grinding gas is consequently decisive for the achievable final speed of grinding material and particles for the finest-grade crushing, that is, for a final fineness of ground particles of <5 μm-10 μm and is given by:

$$\upsilon = \sqrt{2 \cdot \frac{\kappa}{\kappa - 1} \cdot R \cdot T_0 \cdot \left[1 - \left(\frac{p_e}{p_0}\right)^{\frac{\kappa-1}{\kappa}}\right]}$$

The applied energy, finally, is decisive for the flow rate of grinding material in a machine of a given size, and for the adiabatic expansion the result is:

$$E = \frac{m}{2} \cdot \upsilon^2$$

This leads, for example, for nitrogen: $p_0$=4 bar(abs); $T_0$=20° C.

water vapor: $p_0$=40 bar(abs); $T_0$=320° C.

hydrogen: $p_0$=4 bar(abs); $T_0$=20° C.

with the corresponding specific magnitudes, to the following results:

| | $N_2$ | Water vapor | $H_2$ |
|---|---|---|---|
| Isentropic exponent κ | 1.4 | | 1.41 |
| Gas constant R [J/kgK] | 297 | | 4124 |
| Dynamic viscosity [$10^{-6}$ Pas] | 16.6 | 14.2 | 8.4 |
| Density, unstressed [kg/m$^3$] | 1.25 | 0.57 | 0.09 |
| Sound velocity $c_0$ [m/s] | 343 | 504 | 1280 |
| Adiabatic sound velocity [m/s] | 449 | 1150 | 1661 |

As shown in the table, the jet speed (adiabatic sound velocity) with hydrogen is about 3.7—fold in comparison with nitrogen. Thus the kinetic energy of the particles on collision in comparison with hydrogen and nitrogen is about 13.6 times as great, constituting a significant advantage for the finest degree of crushing.

The invention is presented in the description section only by examples and through embodiments and preferred configurations and is not restricted to them, but rather includes all variations, modifications, substitutions and combinations that a person skilled in the art can obtain from the present documents, in particular in the context of the claims and the general depictions in the introduction to this description as well as in the description of the embodiments and that such a person can combine with their technical knowledge and with the prior art. In particular, all individual features and all possible configuration possibilities of the invention can be combined.

What is claimed is:

1. A method for the crushing of grinding material by a mill, which contains a grinding chamber that is connected to a grinding material feed and an outlet for ground particles, and grinding devices for producing particles of a desired fineness from the fed grinding material, said method comprises:

grinding the grinding material in the grinding chamber;

introducing a reduction gas into the grinding chamber during the grinding step to provide a reducing atmosphere; and adjusting operating parameters of the mill to ensure a reduction reaction between the reduction gas and ground particles which produces ground particles without oxygen contamination or ground particles with an oxygen contamination lower than that achieved by grinding in a protective gas atmosphere;

wherein the reduction gas includes carbon monoxide or hydrogen.

2. The method according to claim 1, wherein said grinding is performed with a degree of the fineness equal to $d_{50}<1$ μm.

3. The method according to claim 1, wherein the reduction gas comprises a mixture of the carbon monoxide and hydrogen.

4. The method according to claim 1, wherein the grinding occurs in at least one run of grinding material that has already been ground at least once by the mill.

5. The method according to claim 1, further includes a step of air classification.

6. The method according to claim 1, wherein the mill is a continuously operated dry agitator mill.

7. The method according to claim 1, wherein the mill is a jet mill in which the crushing of grinding material occurs by means of jet grinding with the use of grinder gas in the form of grinder gas jets to produce particles of desired fineness, and the grinder gas contains the reduction gas or serves as the reduction gas that is required for the reduction reaction to which the ground particles are to be subjected.

8. The method according to claim 1, wherein the grinding occurs in several runs of grinding material that has already been ground at least once by the mill.

9. A mill comprising:

a grinding chamber, which is connected to a feed for grinding material and an outlet for ground particles and contains grinding devices to produce particles of a desired fineness from the fed grinding material, wherein during a grinding process, the grinding chamber receives a reduction gas to provide a reducing atmosphere, wherein the mill comprises a controller that adjusts operating parameters of the mill to ensure a reduction reaction between the reduction gas and ground particles which produces ground particles without oxygen contamination or ground particles with an oxygen contamination lower than that achieved by grinding in a protective gas atmosphere, and wherein the reduction gas includes carbon monoxide or hydrogen.

10. The mill according to claim 9, wherein the degree of the fineness of the grinding is equal to $d_{50}<1$ μm.

11. The mill according to claim 9, wherein the reduction gas comprises a mixture of the carbon monoxide and hydrogen.

12. The mill according to claim 9, wherein feedback devices are provided from the outlet for ground particles to the feed for grinding materials, so that particles ground at least once are further grindable.

13. The mill according to claim 9, wherein an air classifier is integrated in the mill.

14. The mill according to claim 9, wherein the mill is a dry agitator mill.

15. The mill according to claim 14, wherein the mill is a continuously-operated dry agitator mill.

16. The mill according to claim 9, wherein said mill is a jet mill that contains nozzles for directing jets of grinding gas into an interior of the grinding chamber to produce particles of the desired fineness by jet grinding the fed grinding material, and the grinding gas is or contains the reduction gas for a reduction reaction to the ground particles.

17. The mill according to claim 9, wherein the particles are ground by the grinding devices in at least one run through the mill.

18. The mill according to claim 9, wherein the particles are ground by the grinding devices in several runs through the mill.

* * * * *